US006168283B1

(12) United States Patent
Howell

(10) Patent No.: US 6,168,283 B1
(45) **Date of Patent: *Jan. 2, 2001**

(54) ELECTROLUMINESCENT LAMP FOR ILLUMINATING PUSH-BUTTON DEVICES

(76) Inventor: Montgomery Brook Howell, 7243 Granvia, Houston, TX (US) 77083

( * ) Notice: Under 35 U.S.C. 154(b), the term of this patent shall be extended for 0 days.

This patent is subject to a terminal disclaimer.

(21) Appl. No.: 09/286,767

(22) Filed: Apr. 6, 1999

Related U.S. Application Data

(63) Continuation of application No. 08/634,026, filed on Apr. 17, 1996, now Pat. No. 5,899,553.

(51) Int. Cl.[7] ..... F21V 9/16
(52) U.S. Cl. ..... 362/84; 362/85; 362/109
(58) Field of Search ..... 362/23, 24, 29, 362/84, 85, 92, 109

(56) References Cited

U.S. PATENT DOCUMENTS

| | | | | |
|---|---|---|---|---|
| 4,124,879 | | 11/1978 | Schoemer | 362/26 |
| 4,320,268 | | 3/1982 | Brown | 200/5 A |
| 4,339,632 | | 7/1982 | Early et al. | 179/90 B |
| 4,532,395 | | 7/1985 | Zukowski | 200/314 |
| 4,667,273 | * | 5/1987 | Queudray | 362/34 |
| 4,683,359 | | 7/1987 | Wojtanek | 200/314 |
| 5,063,484 | | 11/1991 | Tanaka | 362/109 |
| 5,073,843 | | 12/1991 | Magee | 362/84 |
| 5,153,590 | | 10/1992 | Charlier | 341/31 |
| 5,203,622 | | 4/1993 | Sottile | 362/109 |
| 5,315,491 | * | 5/1994 | Spencer et al. | 362/84 |
| 5,434,757 | | 7/1995 | Kashiwagi | 362/80 |
| 5,747,756 | | 5/1998 | Boedecker | 200/5 A |
| 5,899,553 | * | 5/1999 | Howell | 362/84 |

* cited by examiner

*Primary Examiner*—Stephen Husar
(74) *Attorney, Agent, or Firm*—Kurt J. Brown

(57) ABSTRACT

The present invention is an electroluminescent device which proves a means for illuminating push-button devices such as television remote controllers, keypads for security systems, computer keyboards, beepers, night lights, telephones, portable emergency lighting, calculators, and like devices. The invention comprises a power supply which includes an electrical voltage inverter and a power source, and which is connected to a thin and flexible electroluminescent planar sheet containing embedded circuitry and powered by alternating current. The individual components are connected together by electrical leads. The thin electroluminescent lamp portion of the invention provides an even area of template illumination when it is placed over push buttons of an underlying device, and that device can then be used under low-level illumination, or even in complete darkness. Additionally, the present invention allows augmentation of existing illumination. The invention can be added during the manufacturing process, or it can be retrofitted by the end-user to upgrade devices already in use. The planar sheet can be manufactured to glow in one or more of several colors, to suit the needs of the manufacturer or end-user.

18 Claims, 6 Drawing Sheets

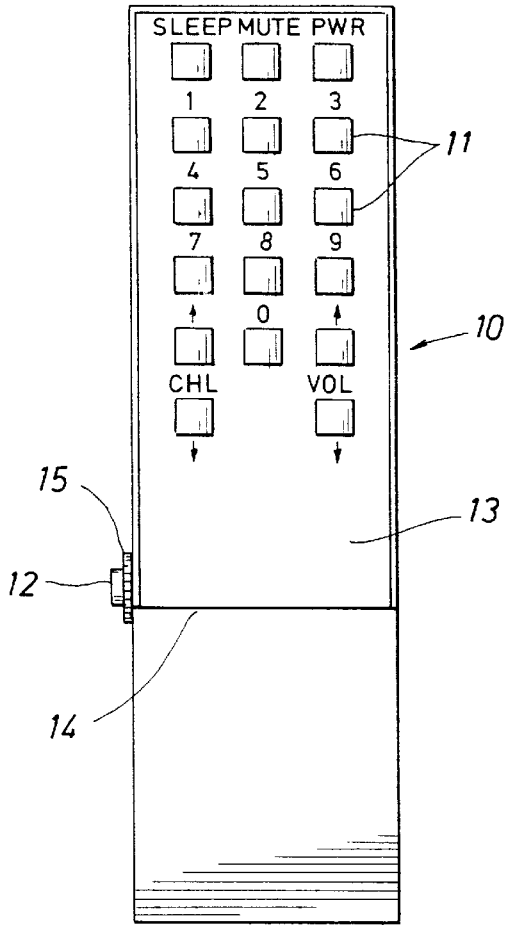
FIG. 1
FIG. 2
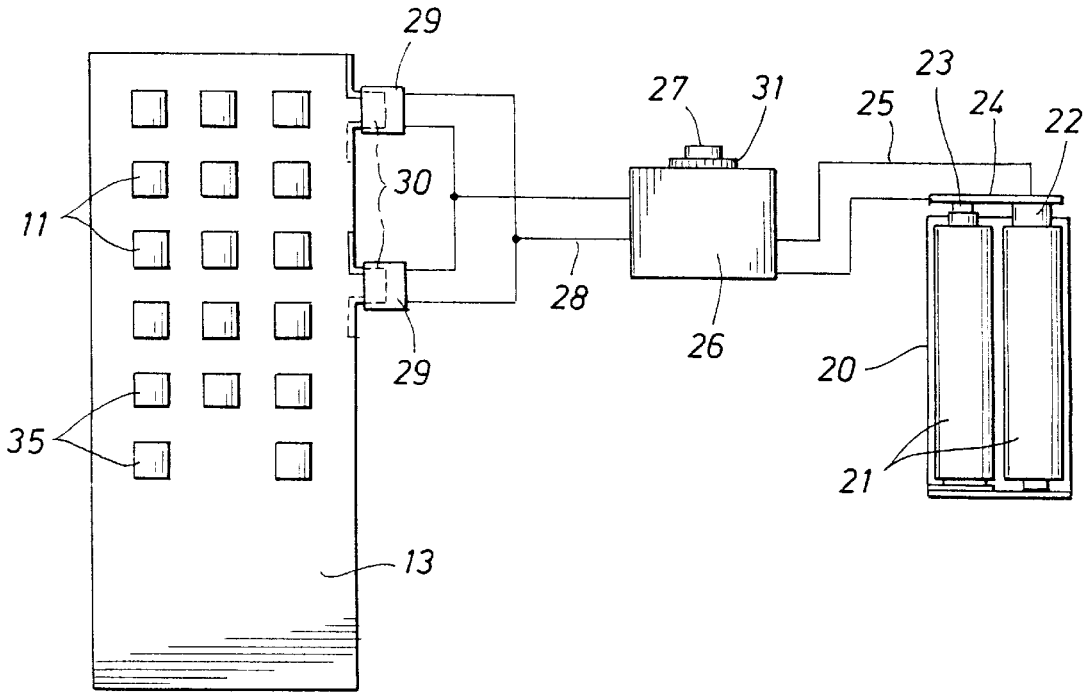

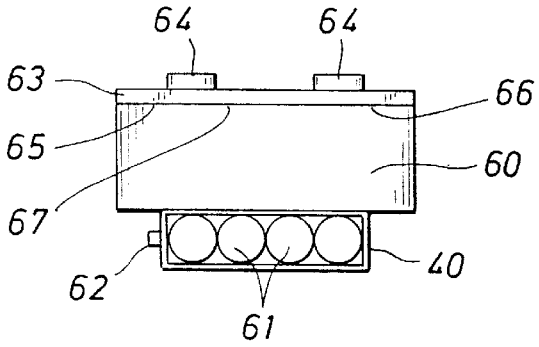
FIG. 3
FIG. 4
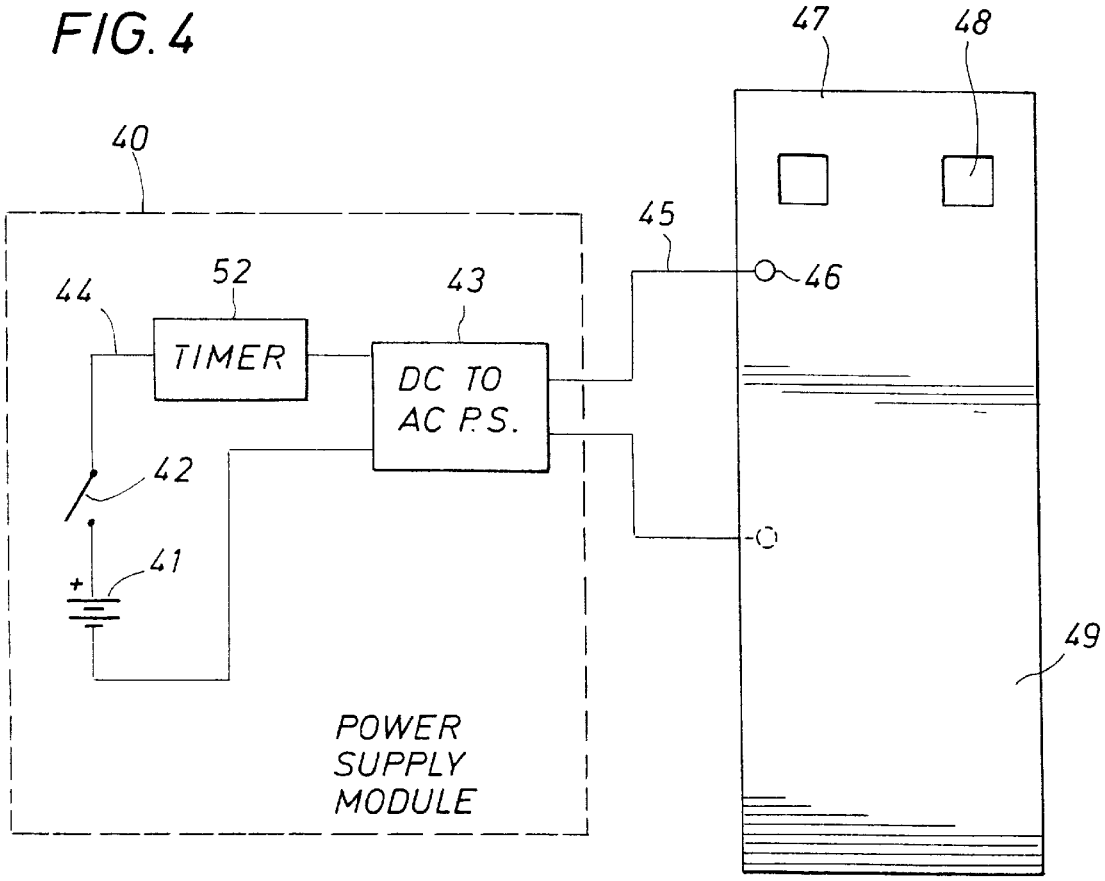
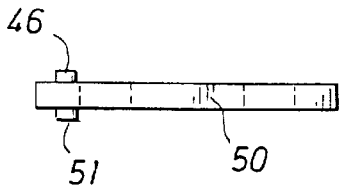
FIG. 5

FIG. 8A
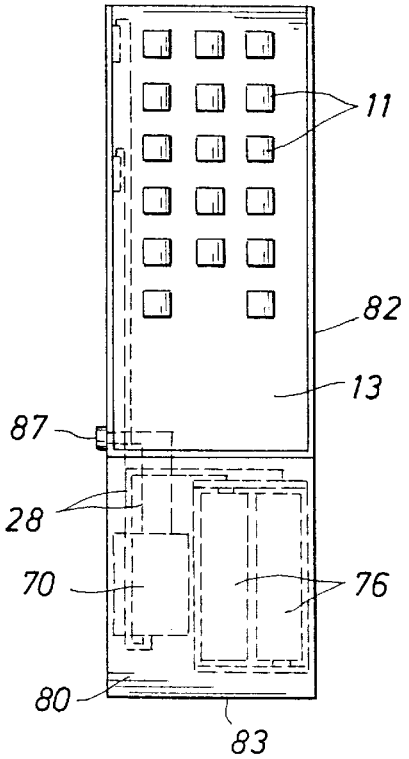
FIG. 8B
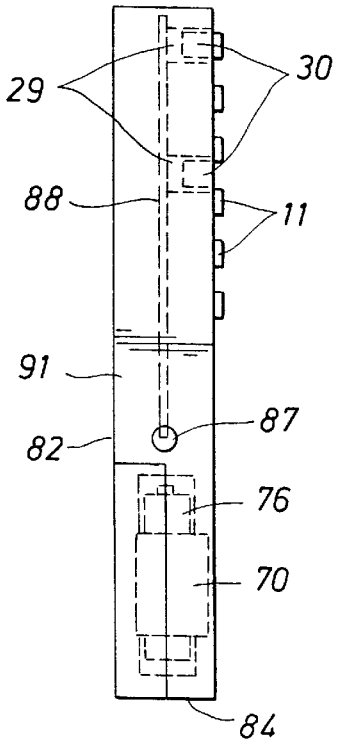
FIG. 8C
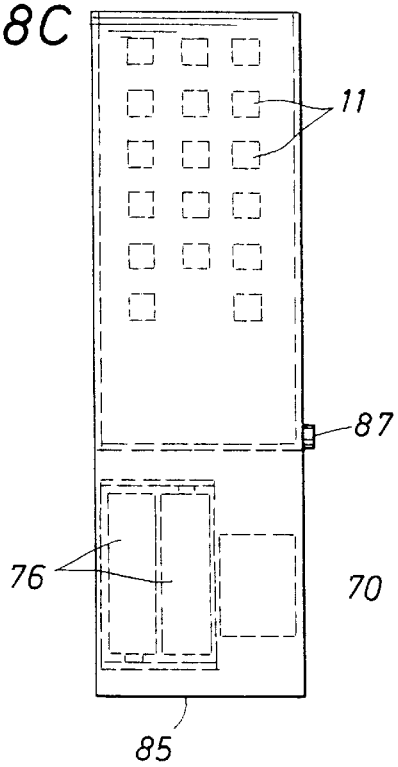
FIG. 8D
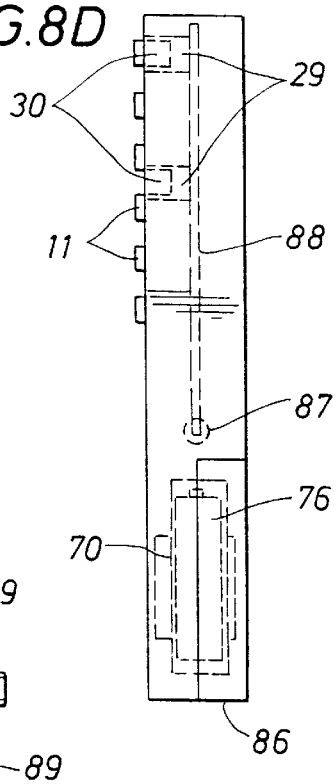
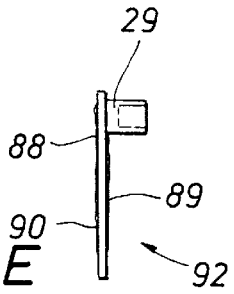
FIG. 8E FIG. 9A
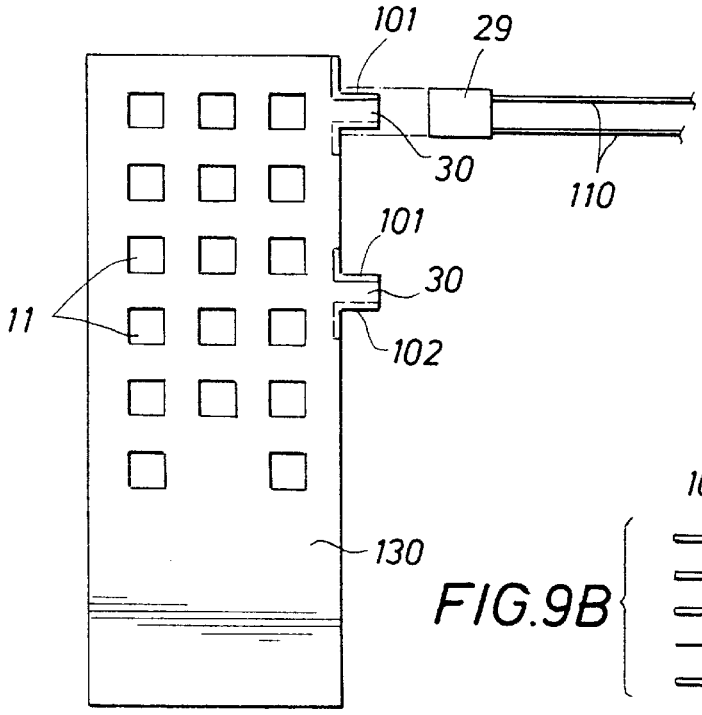
FIG. 9B
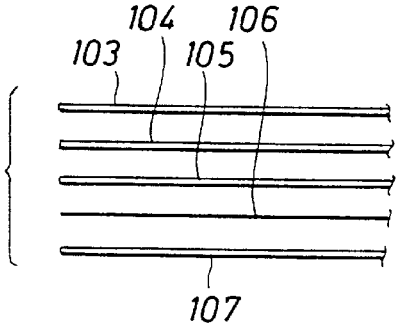
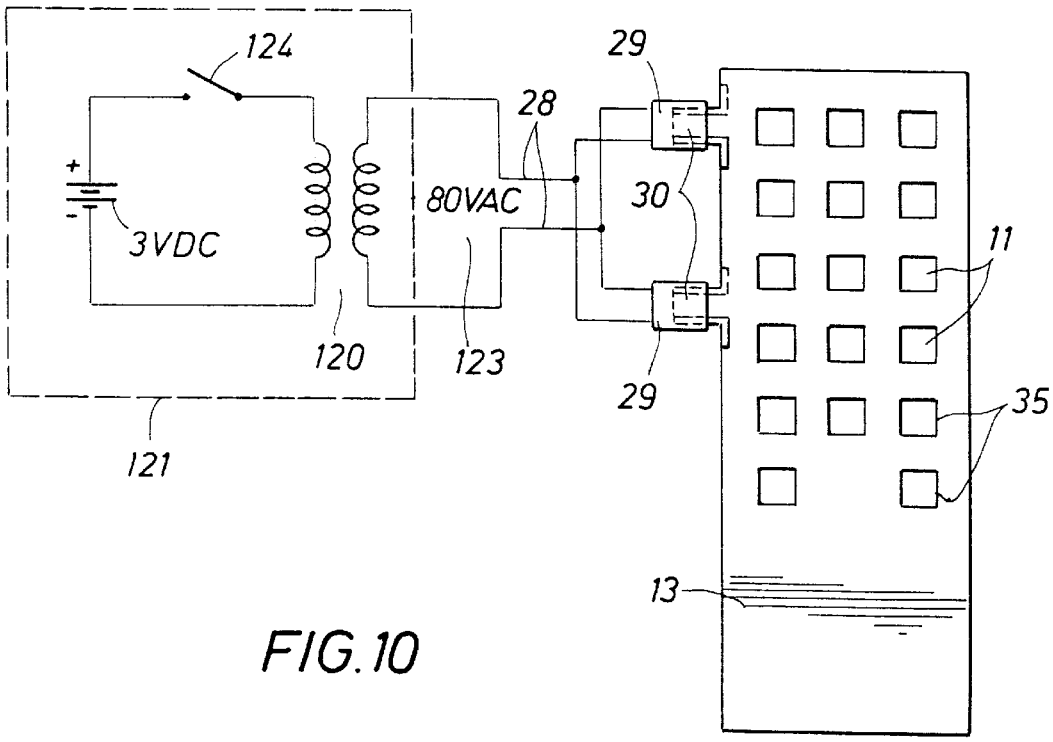
FIG. 10

ELECTROLUMINESCENT LAMP FOR ILLUMINATING PUSH-BUTTON DEVICES

This is a Continuation of U.S. patent application Ser. No. 08/634,026 filed on Apr. 17, 1996, now U.S. Pat. No. 5,899,553.

FIELD OF THE INVENTION

The present invention relates generally to the field of hand-operated illuminating devices, and, more particularly, to a circuit for illuminating a template surrounding push buttons of hand-held devices.

BACKGROUND OF THE INVENTION

Many devices operated by push buttons are used in low light, such as that available to home users during evening hours. Many such commercially available devices are not easily readable under subdued lighting or illumination, like that light emitted by a television screen. To read such devices under low light, one must usually turn on a light or take the device to adequate lighting to read the device.

Illumination added directly to such push-button devices typically involves an incandescent lamp. Incandescent illumination is often overdone or under-done. Further, unevenness in the area of illumination of the device may be harsh to the eye and distracting when the use of the device is merely ancillary to other activities. In situations in which safety and security are primary, turning on an incandescent lamp may expose the user to danger, and may result in a momentary loss of night vision. Exposing the controls in harsh, uneven light makes the use of the remote control device more difficult for the elderly or the visually impaired.

Thus, there remains a need for an apparatus and a method for illuminating such push-button devices that is not under or over done, is not harsh or uneven in illumination for the user or others in the vicinity, and is not distracting to the main activity for which the push-button controller is being used. Such a method of illumination should not unduly expose the user to harm by drawing attention to the use of the device, should not cause a momentary loss of night vision, or make the device more difficult to use. It should allow the user to turn on the light only momentarily. Also, the process of illuminating the device should not cause a change in the normal pattern of using the device, such as by requiring different fingering to turn on other functions.

SUMMARY OF THE INVENTION

The present invention addresses these and other drawbacks of the prior art by providing a templated evenly illuminated source for addition to such push-button devices without relying on unwanted pinpoints of light and in a manner that is pleasing to the eye, is not distracting or attention-gathering, and is an aid rather than a hindrance to regular users of such devices. The illumination method includes an electroluminescent lamp in which a light-emitting phosphor layer and a dielectric layer are sandwiched between conducting surfaces. The electroluminescent layer is activated and illuminated by an alternating current.

The invention includes a power supply and a thin, flexible electroluminescent planar sheet. In one preferred embodiment, the power supply comprises an electrical voltage inverter and a power source. The planar sheet is profiled on the border of the device and contains a templated series of openings placed around push buttons of the device. The planar sheet may be attached to the device by means of an adhesive matrix in the interface between the planar sheet and the surface of the device. The planar sheet has electroluminescent properties due to embedded circuitry which can be powered by the power source, such as a battery, to evenly illuminate the entire surface of the sheet, at a current of approximately 1.0 mA/sq. in. The circuitry is accessed by a terminal that receives a power clip. The power clip is connected to an electrical inverter with electrical leads. Further, additional electrical leads connect the inverter to the battery. A controlled interval or variable interval timer may be added to the circuit such that when a switch is closed, current flows to the timer and the lamp is turned on for a specified interval between arbitrarily selected high and low values.

The invention can be applied to any number of underlying devices. Underlying devices represent finger actuated electrical devices with push buttons which derive some benefit from being illuminated. Such underlying devices may be hand operated. Examples of such underlying devices include but are not limited to stereo and television remote controllers, keypads for security systems, telephones, computer keyboards, beepers, video games, night lights, portable emergency lighting, baby monitors, citizens band radios, money converters, control panel labels, garage door openers, hospital wall and portable intermittent and constant suction devices, intravenous pumps, oxygen wall units, digital ear and oral thermometers, walkie talkies, conventional and microwave ovens, thermostats, clock radios, answering machines, hospital bed controls, and calculators.

When the thin electroluminescent lamp portion of the invention is placed around push buttons of an underlying device, that device can be used under low-level illumination, or even in complete darkness. The invention can be added during the manufacturing process to make such devices usable under low-level illuminating conditions, or it can be retrofitted by the end-user to upgrade devices already in use. The planar sheet can be manufactured to glow in a variety of colors, to suit the needs of the manufacturer or end-user.

The present invention permits lighting an underlying device by template illumination, rather than by back lighting the device. Template illumination allows the invention to be added to preexisting devices without requiring extensive disassembly of such devices, or it may be added to newly manufactured devices. Template lighting also allows custom labels, such as telephone extension names, to be illuminated. Such labels can be added by any available method including but not restricted to sub-surface labels, screen printed or laser printed labels, adhesive fixing of pre-prepared labels, and pen-based hand labeling.

Additionally, the present invention allows augmentation of any existing illumination of push-button devices by bathing the surrounding templated area with an even area of illumination. Because the templated area is lighted, larger, more visible lettering can be used to aid elderly or visually impaired users of such underlying devices. Low-vision users, those whose vision cannot be corrected to generally accepted values in spite of using special magnifiers and optical devices to allow visual imaging, are helped by such lighting. A light background with dark letters offers more visibility to such users than would dark buttons illuminated with tiny pin-points of light.

In addition to aiding low-vision users, the present invention allows the underlying push-button device to be engulfed in an artistic glow of one of several luminous and attractive colors. Such colors can be changed to suit the needs or desires of different users, The different available colors make it practical to differentiate similar devices, such as remote controllers for two distinctive televisions.

Further, although the electroluminescent planar sheet can be made to display different colors of illumination by changing individual phosphors; by actuating a series of phosphors contained in the electroluminescent planar sheet, the background color of the device can be changed to accept programmatic commands when actuated by a computer-like chip. Using combinations of primary colored phosphors of red, yellow and blue, a wide range of background colors can be envisioned. When used for low-level illumination purposes, to satisfy the best scotopic mode, the electroluminescent lamp should be either of white luminescence with black printed indicia thereupon, or of pale yellow luminescence with dark navy blue indicia printed thereupon.

Presently available lights that can be added to such devices by the end-user involve harsh incandescent bulb-type lights. The present invention solves that problem by use of a soothing, evenly illuminated surface. Also, the light source used in the present electroluminescent invention should far outlast incandescent-type illumination sources.

These and other features and advantages of the invention provide significant additions and improvements to the art that are easily perceived by those skilled in these and related arts.

BRIEF DESCRIPTION OF THE DRAWINGS

FIG. 1 depicts a typical underlying device, such as that used in operating home television sets, with a control button added for turning on the electroluminescent lamp.

FIG. 2 displays the basic circuitry of the invention such that a power supply module, which in the illustrated form of the invention contains a power supply and electrical inverter, is connected by electrical leads to an electroluminescent lamp overlaying push buttons of an underlying device.

FIG. 3 displays a basic external embodiment of the invention in side view in which the power supply/inverter pack is adhered to the bottom of an underlying device, and actuated via an on-off switch.

FIG. 4 represents a basic external embodiment of the invention, such that the power supply and DC to AC inverter are contained in a power supply module, which is connected to the thin electroluminescent sheet.

FIG. 5 depicts an end view of the underlying remote device such that the electrical connectors for accessing the electroluminescent sheet are visible.

FIG. 8 shows a wholly internal embodiment in which the invention is contained completely internally within an underlying device. In this conception of the invention, a manufacturer adds the invention wholly internally to an underlying remote device during the manufacturing process, such that the invention is intimately connected to the circuitry of that device.

FIG. 9 demonstrates the means of attachment of the power leads connecting the inverter to the planar electroluminescent lamp. The internal circuitry and layers of a typical lamp are also detailed in this figure.

FIG. 10 displays in schematic mode a typical inverter. Such a device may be transformer-based or chip-based.

DETAILED DESCRIPTION OF THE PREFERRED EMBODIMENTS

Figure 6A:
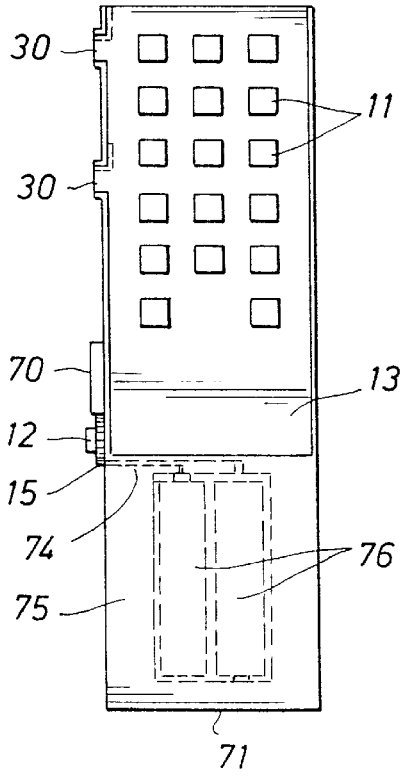
FIG. 6 shows a partially internal embodiment of the invention in which an end-user can add the invention to an existing remote device. The power supply module is contained wholly within the battery compartment of the underlying device.

Three embodiments of the invention are detailed in the following figures. One embodiment involves an electroluminescent device which is external to an underlying remote controller or similar device. A second embodiment of the invention is partially internal and the power supply module is contained wholly within the battery compartment of an underlying device. A third embodiment of the invention is shown in which the invention is contained completely internally within an underlying device such that the power supply module and electrical leads are wholly contained within the main compartment of an underlying device and intimately attached to the circuitry of such a device.

FIG. 1 depicts a typical controller device 10, such as that used for operating home television sets, with an on-off control switch button 12 added on the left aspect for turning on the electroluminescent lamp 13. The lamp 13 preferably comprises a thin planar sheet that develops an electroluminescent response when powered by an electrical source. In this configuration, the illumination on-off control switch button 12, located in a knurled switch housing 15, is placed at the left to accommodate a right handed user, who operates the button using the right thumb or middle finger. The switch button 12 is mounted in a manner such that the switch is easily accessed and yet is isolated from other controls. Also, the switch button allows the device to be lit only when a user wants it lit. The other buttons 11, such as those used to control channel selection, are typically operated using the other thumb or index fingers. Alternately, a left-handed user may place the illumination button at the right, for more comfortable use. The illustrated form of the invention can utilize a push button, a toggle switch, a sliding switch or other such control button.

The electroluminescent lamp 13 features a planar sheet attached to the controller 10 using an adhesive on or at the interface 14 between the underside of the planar sheet and the upper face of the controller. It is perceived that the user will use either a permanent adhesive, or a more temporary and removable adhesive. Details of the attachment configuration are more clearly shown in FIG. 9. The electroluminescent lamp, which can be illuminated with a variety of hues to suit user needs or preferences, allows for viewing such devices under conditions of dim lighting or even absolute darkness.

FIG. 2 depicts the basic circuitry of the invention, and also shows an alternate location for a switch button 27, on a DC to AC electrical voltage inverter 26. The invention can either be added to an underlying device during the initial manufacture, or it can be retrofitted to a pre-existing device. A battery source 20, for example a 3 volt DC source employing two 1.5 volt AA batteries 21, is connected to define a positive terminal 22 and a negative terminal 23, respectively, to a standard battery connector 24, which is in turn attached by wire leads 25 to the inverter 26. The inverter 26 converts the 3 volts DC current to 80 volts AC. DC to AC conversion at a particular voltage, current, and frequency, for purposes of this invention, involves standard principles and is well known to practitioners in the art. The electroluminescent lamp 13, such as Durel® 3 (Durel Corp., 2225 West Chandler Blvd., Chandler, Ariz. 85224, 602/917-

6000), is operated by a voltage of between 80 and 120 volts AC. According to manufacturer specifications, brightness of the lamp at 115 V, 400 Hz is 17 to 23 ft-L. Such luminous material is thinner than a credit card and may be cut with a scissors or knife. Durel® 3 also has a screen printable surface and glows softly and evenly when lit, like that used in wristwatches like the Timex® Indiglo®. This material is available in blue-green, green, white, orange-yellow, and other custom colors. The sheet lamp material, as supplied by the manufacturer, contains distributed internal electrical circuitry for illumination purposes so that portions of the sheet can be cut off to illuminate small surfaces of applicable devices. While the lamp material is moisture resistant, it can be further protected using a plastic cover. The inverter 26 is activated by the switch button 27, located in a knurled switch housing 31, and connected by wire leads 28 to electrical clips 29 which mate with lamp connectors 30.

The thin planar sheet of the electroluminescent lamp material 13 is shown with perforations 35 around and exposing the push buttons 11 of an underlying remote device 10, such as the device shown in FIG. 1. The electroluminescent lamp has a built-in circuit which is shown in FIG. 9. Contemplated in the invention are both pre-cut templated planar sheets to fit over commercially available push-button operated devices, as well as custom-made sheets that are user-prepared and formed by scissors, scalpel, or other knife-like device. The visible surface of the electroluminescent sheet is evenly and softly illuminated in a manner such that labels can be read surrounding the push buttons of the underlying device, while the illumination is not over or under done. The resulting illumination is not overly bright or harsh to the user or others in the vicinity of the user, is not distracting to the main activity for which such a push-button device is used, does not unduly expose the user to harm by drawing attention to the use of such an underlying device, and does not result in a momentary loss of night vision. Such an underlying device is therefore illuminated by template illumination rather than by back lighting. Among advantages of template illumination are that large type can be used on customized labels so that visually-impaired users can see such devices in a superior manner to devices employing dark buttons with tiny points of light illuminating the button labels.

In FIG. 3, the basic external embodiment of the invention is shown. An end view of the remote controller 60 clearly shows the power supply module 40, containing the battery source 61 and switch 62, releasably attached to the back of the remote controller 60. The thin planar electroluminescent lamp sheet 64 is attached with an adhesive matrix 65, in the interface 67 between the lamp sheet 64 and the top surface 66 of the remote controller 60, such that free movement of the push buttons 64 is allowed.

In FIG. 4, the power supply module 40 is shown containing a battery source 41, switch 42, and a DC to AC inverter 43, connected by electrical leads 44. When a switch 2 is closed, current flows to a timer 52 turned on for a specified interval arbitrarily elected within a range of high and low values. Additional leads 45 connect the power supply module 40 to the external connectors 46 of the planar electroluminescent sheet lamp 47, which is cut to expose the push buttons 48 of the underlying remote control device 49.

An end-on view at the bottom aspect of the remote controller 50, is shown in FIG. 5. The connectors at the top 46 and bottom 51 of the electroluminescent sheet allow external electrical connections to be made to the internal illumination circuitry.

Figure 6B:
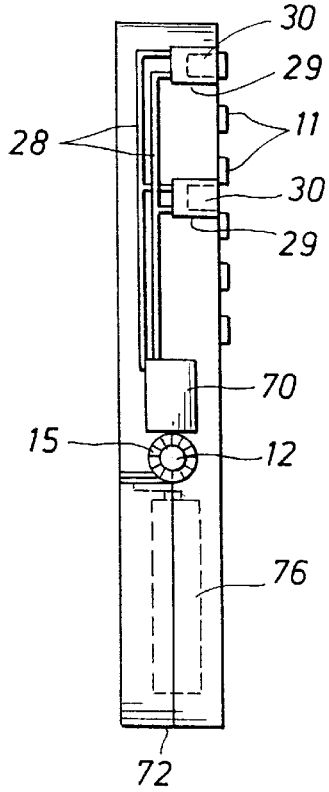
Figure 6C:
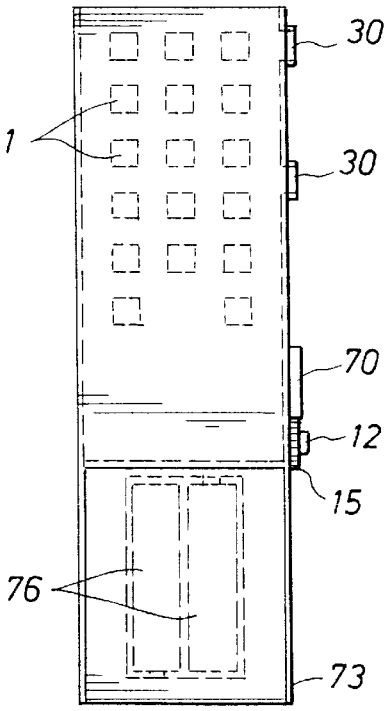
Figure 6D:
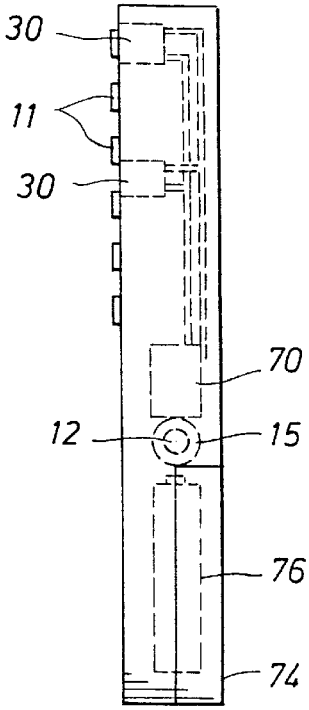

FIG. 6 displays a partially internal embodiment of the invention in which an end-user can add the invention to an existing remote device. A typical underlying device is shown in top view 71, side view 72, bottom view 73, and in a view showing the opposite side 74. Also shown is a chip-based inverter 70 added to the side of the underlying remote device 10 operated by push buttons 11. The illumination on-off control switch button 12, located in a knurled switch housing 15, is also shown mounted to the left side of the underlying device. The lamp connectors 30 of the electroluminescent lamp 13 are shown extending laterally in the top view 71, and bent downward into slots in the case of the underlying device in the side view 72 and opposite side view 74. The electrical clips 29 which mate with the lamp connectors 30 are connected by wire leads 28 to the inverter 70, which is connected by additional leads 74 in the battery compartment 75 of the underlying device. In this embodiment, the invention pulls power directly from the battery source 76 of the underlying device.

Figure 7A:
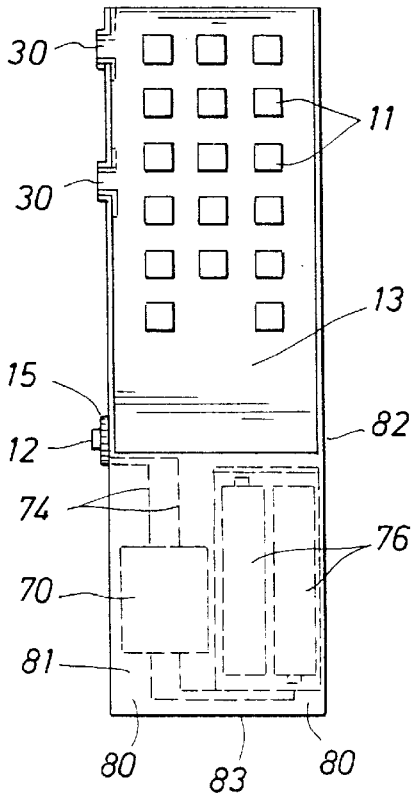
FIG. 7 shows a partially internal embodiment of the invention in which there is an option for a manufacturer to include the power supply module, consisting of the battery and inverter, wholly within the battery compartment of an underlying device.
Figure 7B:
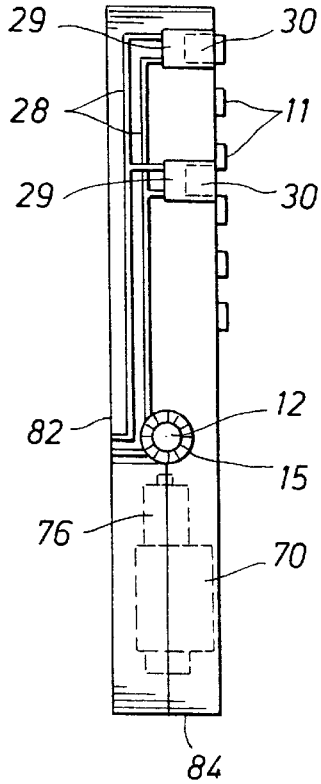
Figure 7C:
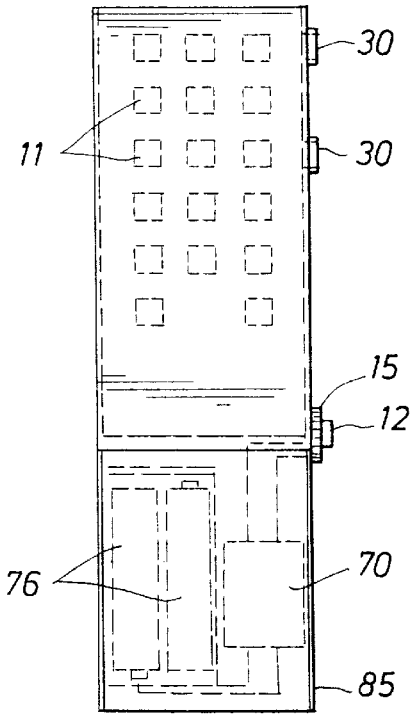
Figure 7D:
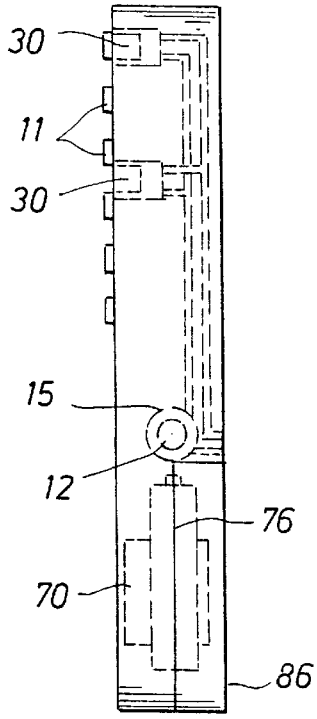

FIG. 7 shows a partially internal embodiment of the invention in which there is an option for a manufacturer to include the power supply module 80, consisting of the battery 76 and inverter 70, wholly within the battery compartment 81 of an underlying remote device 82 operated by push buttons 11. A typical underlying device is shown in top view 83, side view 84, bottom view 85, and in a view showing the opposite side 86. The illumination on-off control switch button 12, located in a knurled switch housing 15, is also shown mounted to the left side of the underlying device. The lamp connectors 30 of the electroluminescent lamp 13 are shown extending laterally in the top view 83, and bent downward into slots in the case of the underlying device in the side view 84 and opposite side view 86. The electrical clips 29 which mate with the lamp connectors 30 are connected by wire leads 28 to the inverter 70, which is connected by additional leads 74 in the battery compartment 80 of the underlying device. The wire leads 28, 74 may extend either partially within the casing of an underlying device 82, or externally to the casing and located on the side 84 of the device. When the leads are external, they consist of insulated copper wire with adhesive on one side, such as those used in children's doll houses. For an embodiment in which the leads are wholly internal, reference is made to FIG. 8.

FIG. 8 shows a wholly internal embodiment in which the invention is contained completely internally within an underlying device 82 operated by push buttons 11, and in which the power supply module 70, consisting of the battery 76 and inverter 70, and electrical leads 28 are also either wholly contained within the main compartment 91 or within the battery compartment 80 of the remote control device 82, and intimately attached to the circuit board 88 of the controller device such that only the planar electroluminescent sheet 13 and a portion of its electrical clip attachments 30 are visible at the outside aspect of the controller. A typical underlying device is shown in top view 83, side view 84, bottom view 85, and in a view showing the opposite side 86. Additionally, a close-up view 92 is shown of the solderless connection of the electrical clips 29 which mate with lamp connectors 30, and with the positive 89 and negative 90 copper leads of the circuit board 88 of an underlying device. The illumination on-off control switch button 87 is depicted at the left side of the remote device. In this conception of the invention, a manufacturer adds the invention wholly internally to an underlying remote device during the manufacturing process, such that the invention is intimately connected to the circuitry of that device.

FIG. 9 shows the means of attachment of the external clip 29 from the power leads 110 connecting the inverter (not shown in this figure) to the profiled edge of the planar electroluminescent lamp 13. The Durel® 3 lamp, for example, employs electrical contact clips 29 which mate with the lamp connectors 30 at the external edge of the lamp to access the internal circuitry of the lamp and to turn on the lamp. A connector consists of a top cathodal surface 101 and a bottom anode 102, allowing external electrical connections to the electroluminescent lamp. The Durel® 3 lamp, according to information from the manufacturer, can be accessed by silver pad leads (attached with conductive adhesive or a zero-insertion force connector), copper ribbon leads, or as in this depiction, solderless pin connectors 110.

The internal circuitry and layers of this particular lamp are also detailed in FIG. 9. The lamp is approximately 0.010" to 0.013" thick, formed primarily of a polyester substrate transparent electrode 103, a colored phosphorus layer 104, a dielectric layer 105, a rear electrode 106, and a rear insulator 107.

FIG. 10 displays in schematic mode a typical inverter. Such a device may be transformer-based or chip-based, and the principles of operation of such an inverter are well known to those skilled in the art. The electroluminescent lamp 13 is shown with perforations 35 surrounding the push buttons 11 of an underlying device (not shown in this drawing). The electroluminescent lamp 13 is accessed by electrical clips 29 which mate with the lamp connectors 30, which are in turn connected by wire leads 28 to the inverter 120. The inverter 120, shown in a box 121, converts DC current from a battery source 122 to AC current 123, to turn on the lamp 13 when a switch 124 is activated.

The principles, preferred embodiments, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A device for illuminating an appliance, the appliance having push buttons each having an associated function, comprising:

(a) an electroluminescent sheet powered by the power supply to develop an illumination response, wherein the electroluminescent sheet is disposed in a surrounding relationship to the push buttons so that illumination of the sheet outlines at least a portion of an outer periphery of each button;

(b) written indicia disposed on the electroluminescent sheet and associated with the push buttons for identifying the function of the buttons, the written indicia being printed on the electroluminescent sheet at a position proximate each associated button;

(c) the push buttons being arranged in a rectangular array, and the written indicia being printed in a rectangular formation having substantially the same length and width as the button array;

(d) electrical conductors that conduct electrical power to the electroluminescent sheet; and (e) means for selectively actuating the electroluminescent sheet.

2. The device of claim 1, where the actuating means comprises an on-off switch.

3. The device of claim 2, wherein the on-off switch is mounted externally on the appliance at a location spaced from the electroluminescent sheet.

4. The device of claim 3, wherein the electroluminescent sheet has templated openings that expose the push buttons of the underlying appliance, whereby the entire outer periphery of each button is outlined.

5. The device of claim 2, further comprising a timer connected to the on-off switch, whereby the sheet remains illuminated for a predetermined time interval determined by the timer following actuation of the on-off switch.

6. The device of claim 1, wherein the appliance is a hand held remote control unit, and the written indicia identify functions of a machine controlled by the remote control unit.

7. The device of claim 1, wherein the electroluminescent sheet is secured to an underlying surface of the appliance by an adhesive.

8. The device of claim 1, wherein the written indicia are printed on the electroluminescent sheet.

9. The device of claim 1, wherein the written indicia appear on labels which are superposed on the electroluminescent sheet.

10. The device of claim 1, wherein the power supply comprises a battery stored within the appliance, and the device further comprises an inverter connected to the electroluminescent sheet and the power supply in a manner effect to convert direct current from the battery to an alternating current conducted through the electrical conductors and used by the electroluminescent sheet.

11. The device of claim 1, wherein the written indicia include words or alphabetical multicharacter abbreviations.

12. The device of claim 1, wherein the electroluminescent sheet is opaque and includes a pair of electrode layers having a colored phosphorous layer and a dielectric layer disposed therebetween.

13. The device of claim 1, wherein the electrical conductors connect terminal portions of the electroluminescent sheet to the power supply of the appliance.

14. An illumination source on an underlying device with push buttons, the illumination source comprising:

(a) a power supply;

(b) an electroluminescent responsive planar sheet powered by the power supply to develop an illumination response, wherein the sheet has templated openings which expose push buttons of the underlying device, the push buttons being arranged in a rectangular array;

(c) wherein the planar sheet, having an edge, is provided with power from the power supply coupled to a terminal on the edge of the planar sheet;

(d) written indicia associated with the push buttons, the written indicia being printed in a rectangular formation having substantially the same length and width as the button array;

(e) electrical connections connecting the terminal to the power supply; and (f) an on-off switch on the underlying device for controlling distribution of power from the power supply to the electroluminescent sheet.

15. The illumination source of claim 14, further comprising labels illuminated by the electroluminescent sheet, which labels are positioned on the electroluminescent sheet proximate the push buttons to identify the push buttons.

16. A method of using an appliance of the type used under low or no light conditions, the appliance having push buttons each having an associated function and a power supply. and further having an illumination device including an electroluminescent sheet powered by the power supply to develop an illumination response, wherein the electroluminescent sheet is disposed in a surrounding relationship to the push buttons so that illumination of the sheet outlines at least a portion of an outer periphery of each button, written indicia disposed on the electroluminescent sheet and associated with the push buttons identifying the function of each button, electrical connections for conducting electrical power to the electroluminescent sheet, and a switch for selectively actuating the electroluminescent sheet. and the appliance being a hand held remote control unit, comprising:

(a) actuating the electroluminescent sheet by operating the switch to illuminate the sheet;

(b) operating the device using the push buttons; and (c) deactivating the electroluminescent sheet.

17. The method of claim 16, wherein the deactivating step is carried out by a timer which deactivates the electroluminescent sheet following a predetermined time interval.

18. The method of claim 16, wherein the step of operating the appliance further comprises reading the written indicia by the light produced by the electroluminescent sheet.

* * * * *